US006104823A

United States Patent [19]

Tanaka

[11] Patent Number: 6,104,823

[45] **Date of Patent: *Aug. 15, 2000**

[54] SPEAKER SYSTEM

[75] Inventor: Hidekazu Tanaka, Matsusaka, Japan

[73] Assignee: Matsushita Electric Industrial Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/026,684

[22] Filed: Feb. 20, 1998

[30] Foreign Application Priority Data

Feb. 21, 1997 [JP] Japan ..... 9-037575

[51] Int. Cl.[7] ..... H04R 1/02

[52] U.S. Cl. ..... 381/345; 381/353; 381/386; 381/349; 181/199

[58] Field of Search ..... 381/345, 346, 381/348, 349, 353, 354, 386, 395, 392, FOR 145, FOR 146, FOR 151, 87; 181/151, 156, 199, 146

[56] References Cited

U.S. PATENT DOCUMENTS

| | | | |
|---|---|---|---|
| 2,121,008 | 6/1938 | Billhuber | 381/392 |
| 2,852,087 | 9/1958 | Ruschhaupt | 181/151 |
| 3,592,290 | 7/1971 | Armstrong | 381/349 |
| 4,939,783 | 7/1990 | Dunning | 381/349 |
| 4,953,655 | 9/1990 | Furukawa | 381/349 |
| 6,005,957 | 12/1999 | Meeks | 381/386 |

*Primary Examiner*—Huyen Le
*Attorney, Agent, or Firm*—McDermott, Will & Emery

[57] ABSTRACT

A speaker system excellent in reproduction in bass range, which comprises a reinforcing post 3*a* to abut against the back side of a speaker unit 5 installed in a front cabinet 2. The reinforcing post 3*a* is formed integrally in a back cabinet 3, and is fixed with a cover 4. In this constitution, unwanted vibrations generated in the back cabinet 3, cover 4, and speaker unit 5 due to rear release wave b can be suppressed.

15 Claims, 7 Drawing Sheets

SPEAKER SYSTEM

BACKGROUND OF THE INVENTION

The present invention relates to a speaker system used in video appliances such as television receivers, and various audio appliances in automobiles, information communications, etc.

A conventional speaker system is described below while referring to a structural sectional view in FIG. 7 and a perspective exploded view in FIG. 8. A speaker box 1 in the conventional speaker system is composed of a front cabinet 2, a back cabinet 3, and a cover 4, and they are mutually fixed by mounting screws 6. A speaker unit 5 is installed in the opening of the front cabinet 2 to be accommodated in the speaker box 1, and an input cord 7 is connected to the speaker unit 5. A first sound guide c and a second sound guide d are formed in the speaker box 1. Arrow a shown in FIG. 7 indicates a front release wave emitted from the front side of the speaker unit 5, and arrow b denotes a rear release wave emitted from the rear side of the speaker unit 5.

In thus constituted conventional speaker system, the operation is described below. First, when an electric signal is applied to the input cord 7, it is transmitted to the speaker unit 5, and is converted into an acoustic signal by the speaker unit 5, and a sound wave is generated. At this time, the sound emitted from the front side of the speaker unit 5 is generated as a positive front release wave a, and the rear release wave b emitted from the rear side of the speaker unit 5 is extracted by sound guides c, d, so that the bass range that cannot be delivered by the speaker unit 5 alone can be reproduced.

In such conventional constitution, however, due to the vibration of the speaker unit 5 itself or the pressure of the rear release wave b emitted from the speaker unit 5, the back cabinet 3 and the cover 4 in the vicinity of the speaker unit 5 vibrate, which affects the bass range characteristic. If a strong impact is applied to the speaker unit, moreover, the speaker unit 5 may fall out of the front cabinet 2 mounting by the screws 6 is insufficient, and also in the recent trend of reduction of weight of the speaker system, since resins materials are widely used in the speaker, the strength of the front cabinet 2 and back cabinet 3 cannot be reinforced structurally, and therefore enhancement of strength is demanded.

SUMMARY OF THE INVENTION

It is hence a primary object of the invention to present a speaker system suppressed in generation of unwanted vibration, superior in strength, and excellent in durability.

A speaker system of the invention comprises a front cabinet having an opening, a speaker unit fitted to its opening, and a back cabinet forming a space for accommodating this speaker unit together with the front cabinet, and it further comprises suppressing means for suppressing generation of unwanted vibration. By this suppressing means, unwanted vibration of the speaker unit itself, and unwanted vibration of the speaker box near the speaker unit due to pressure of the rear release wave emitted from the speaker unit are suppressed, so that reproduction of bass range necessary for the speaker system can be easily realized.

In a preferred aspect of the speaker system of the invention, as suppressing means, a reinforcing post is disposed in the back cabinet to abut against the back side of the speaker unit. By disposing this reinforcing post, the unwanted vibration of the speaker unit itself is suppressed, and the back cabinet itself becomes also rigid and is less likely to generated unwanted vibration, and the reproduction of bass range is improved. If a strong impact is applied, the speaker unit rarely falls out the front cabinet.

In other preferred aspect of the invention, as suppressing means, a flow-adjusting wall is disposed in the back cabinet to abut against the back side of the speaker unit. This flow-adjusting wall is similarly effective to suppress the unwanted vibration of the speaker unit and others, and moreover since it adjusts the flow of air of the rear release wave, it is also effective to enhance the sound pressure frequency characteristic.

In another preferred aspect of the invention, as suppressing means, coupling means for coupling firmly the front cabinet and back cabinet is provided in each cabinet. As a result, generation of unwanted vibration of both cabinets is suppressed, and reproduction of bass range is improved.

DESCRIPTION OF THE PREFERRED EMBODIMENTS

Figure 1:
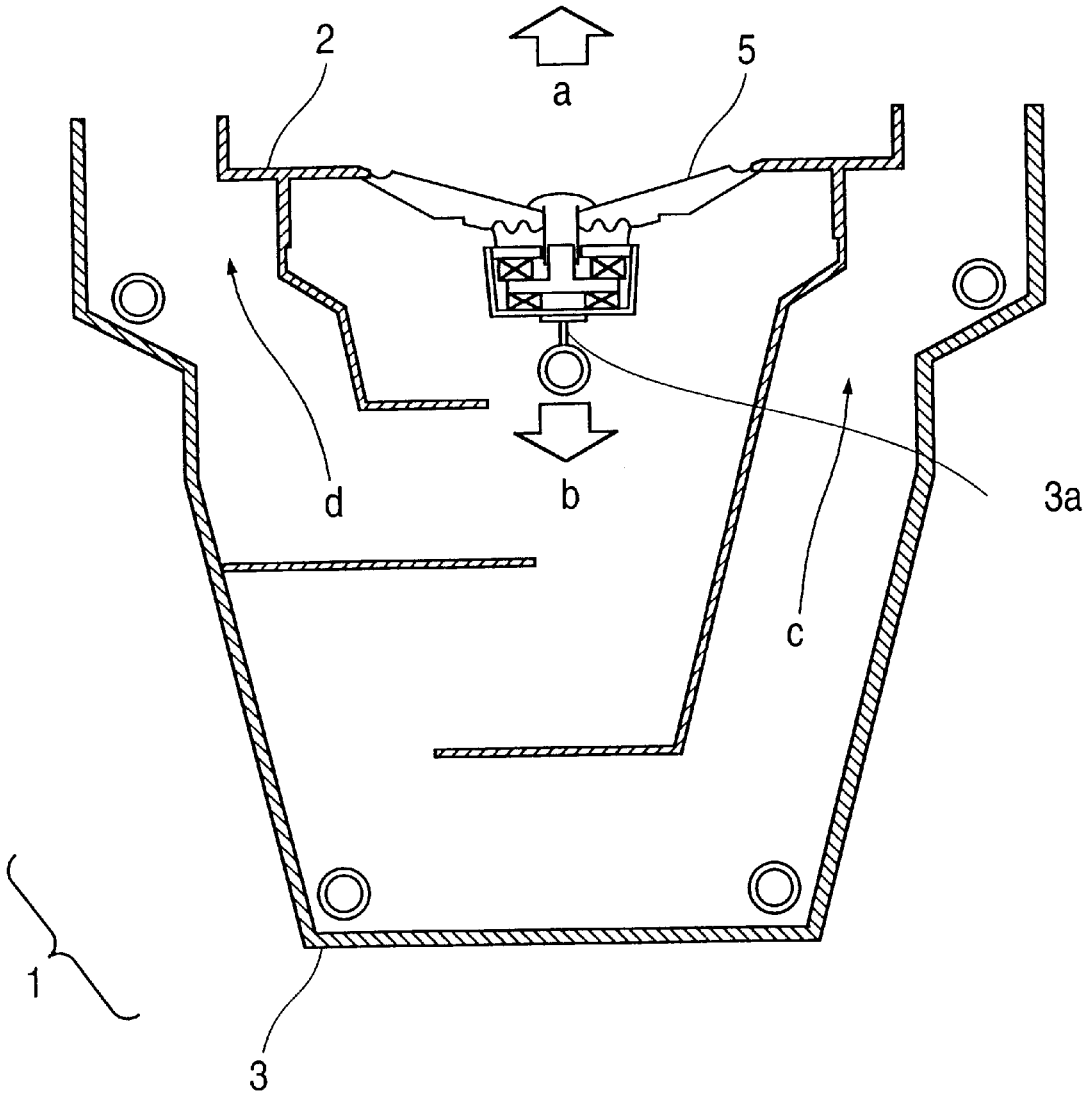
FIG. 1 is a sectional view of a speaker system in embodiment 1 of the invention.

Preferred embodiments of the speaker system of the invention are described below while referring to the accompanying drawings. In the description, the same parts as in the prior art are identified with same reference numerals and the explanation is omitted.

Embodiment 1

Figure 2:
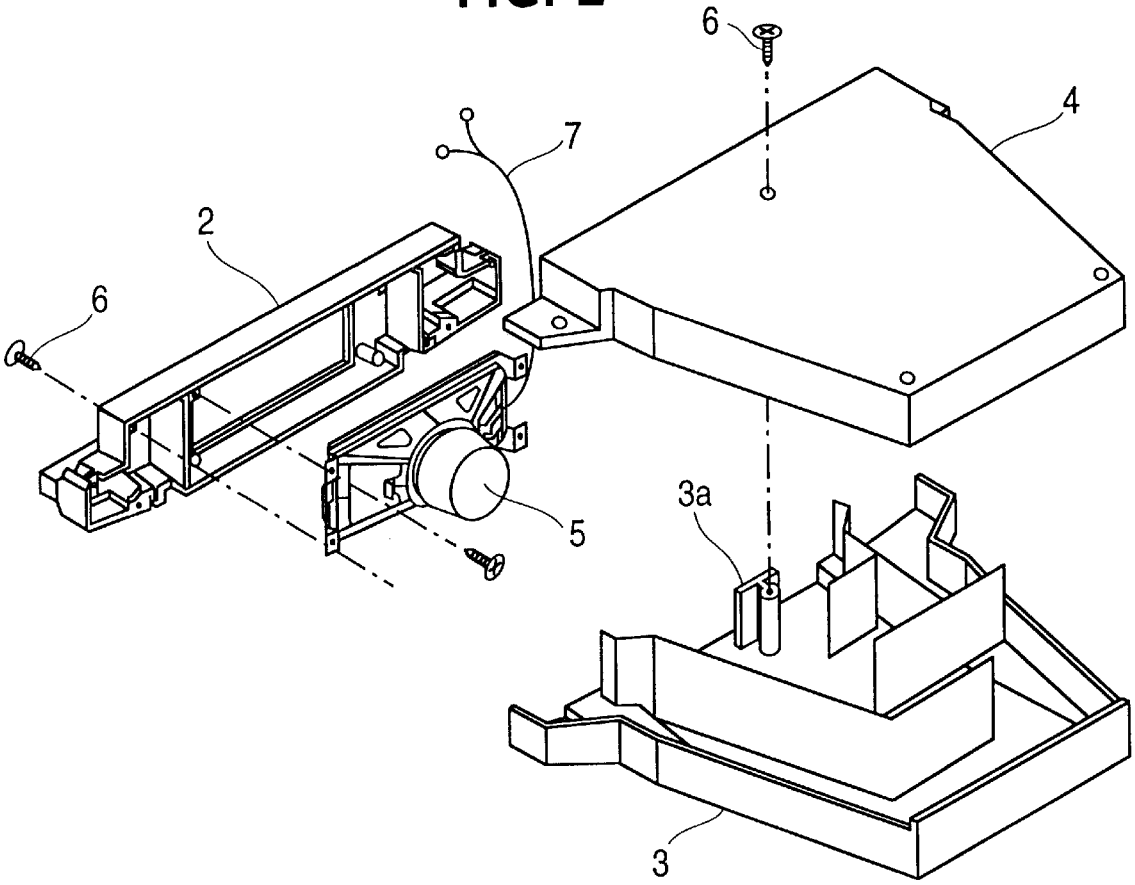
FIG. 2 is a perspective exploded view of this speaker system.
Figure 3:
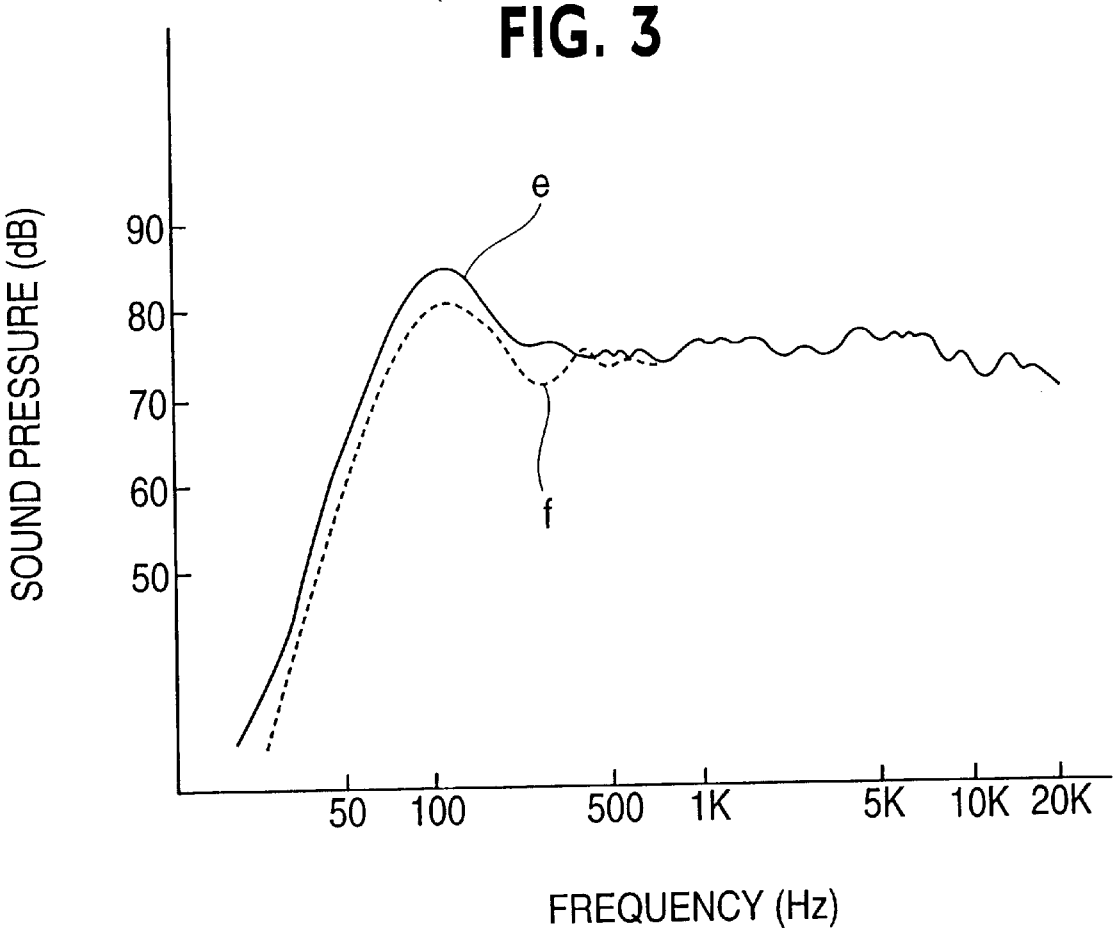
FIG. 3 is a sound pressure frequency characteristic diagram of this speaker system.

FIG. 1 is a sectional view of a speaker system in embodiment 1 of the invention, FIG. 2 is its perspective exploded view, and FIG. 3 is its sound pressure frequency characteristic diagram. Relating only to the different points from the prior art according to the drawings, the difference lies in that a reinforcing post 3*a* is provided in a back cabinet 3 so as to abut against the back side of a speaker unit 5 installed in a front cabinet 2, and that this reinforcing post 3*a* is coupled with a cover 4 by means of mounting screws 6.

In thus constituted speaker system, the operation is described below.

First, when an electric signal is applied to an input cord 7, it is converted into an acoustic signal, and a sound wave is generated. As the sound wave at this time, the sound emitted from the front side of the speaker unit 5 is generated as a positive front release wave a, and the sound emitted from the rear side of the speaker unit 5 is generated as a negative rear release wave b.

At this time, the speaker unit 5 also vibrates, but since the reinforcing post 3*a* is in contact with the back side of the speaker unit 5, the vibration of the speaker unit 5 is suppressed.

By the pressure of the rear release wave b, the back cabinet 3 and the cover 4 in the vicinity of the speaker unit 5 are inclined to oscillate and move as if breathing, but since the back cabinet 3 and cover 4 are coupled through the reinforcing post 3*a* of the back cabinet 3, the unwanted vibration of the back cabinet 3 and cover 4 due to pressure of the rear release wave b is suppressed, and the bass range characteristic is free from deterioration.

When a strong impact is given, dropout of the speaker unit 5 can be prevented and a high reliability is assured.

FIG. 3 shows a sound pressure frequency characteristic e of the speaker system in embodiment 1 and a sound pressure frequency characteristic f of a conventional speaker system, and it has been confirmed to be superior to the prior art in the bass characteristic as described above.

Meanwhile, if the front cabinet 2 and cover 4 are made of weak material such as resin, the strength is assured, and the speaker system of highly durable structure free from deterioration in bass range characteristic can be obtained.

Embodiment 2

Figure 4:
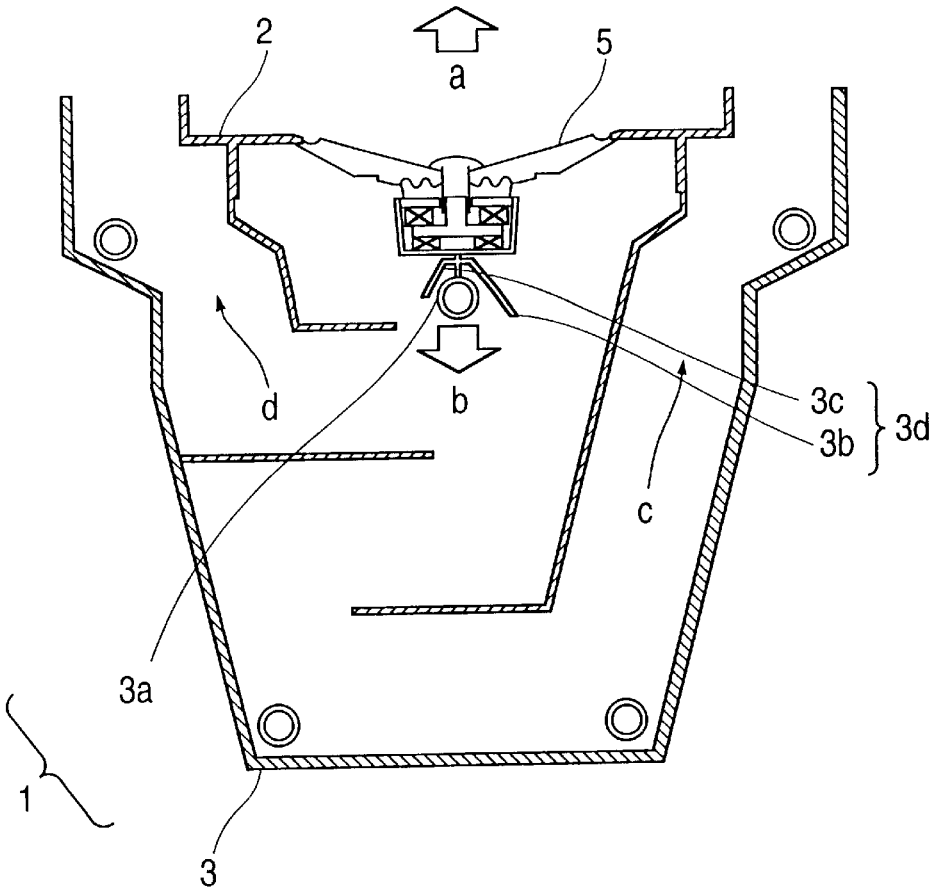
FIG. 4 is a sectional view of a speaker system in embodiment 2 of the invention.

FIG. 4 is a sectional view of a speaker system in embodiment 2 of the invention. Relating only to the difference from embodiment 1 according to the drawing, the back cabinet 3 is provided with a flow-adjusting wall 3*d* comprising a first flow-adjusting wall 3*b* extended in a direction of a first sound guide c and a second flow-adjusting wall 3*c* extended in a direction of a second sound guide d, abutting against the back side of the speaker unit 5 installed in the front cabinet 2, for preventing disturbance of the rear release wave b at the back side of the speaker unit 5. In embodiment 2, the cover 4 is coupled by the reinforcing post 3*a* consecutive to this flow-adjusting wall 3*d*, but depending on the output of the speaker unit 5, without using reinforcing post 3*a*, the cover 4 may be coupled with the flow-adjusting wall 3*d*.

Thus, in embodiment 2, by coupling the back cabinet 3 and cover 4 through the flow-adjusting wall 3*d*, and keeping the back side of the speaker unit 5 in contact with the flow-adjusting wall 3*d*, same as in embodiment 1, the unwanted vibration of the back cabinet 3 and cover 4 due to pressure of the rear release wave b and unwanted vibration of the speaker unit 5 itself are suppressed, deterioration of bass range characteristic is prevented, the flow of air of the rear release wave b is adjusted by the flow-adjusting wall 3*d*, blowing sound generated at the inlet of the sound guide c and sound guide d is suppressed, and the sound pressure frequency characteristic is further enhanced.

Embodiment 3

Figure 5:
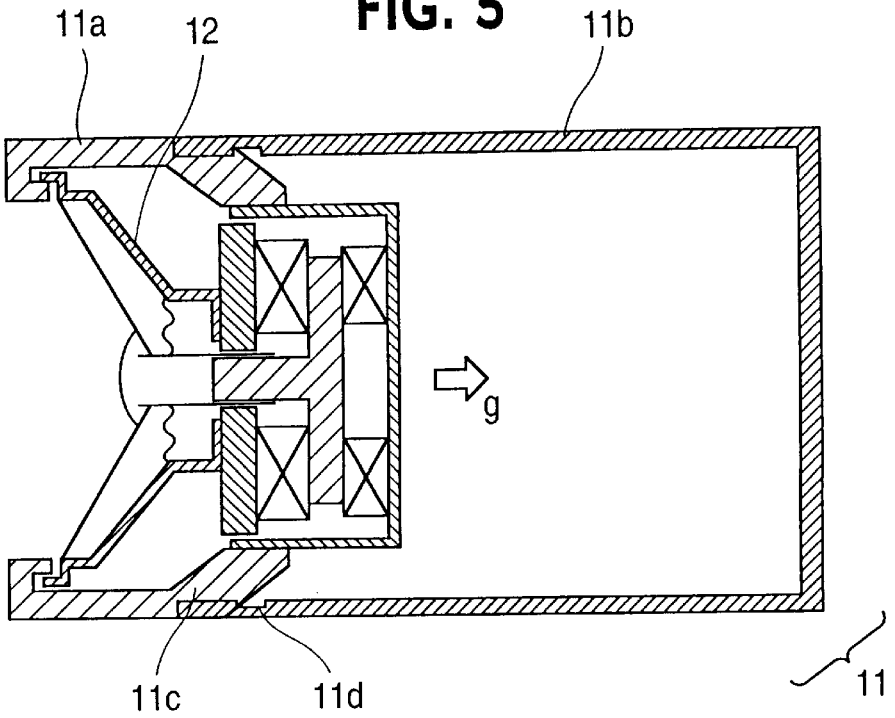
FIG. 5 is a sectional view of a speaker system in embodiment 3 of the invention and FIG. 6 is a perspective exploded view of this speaker system.
Figure 6:
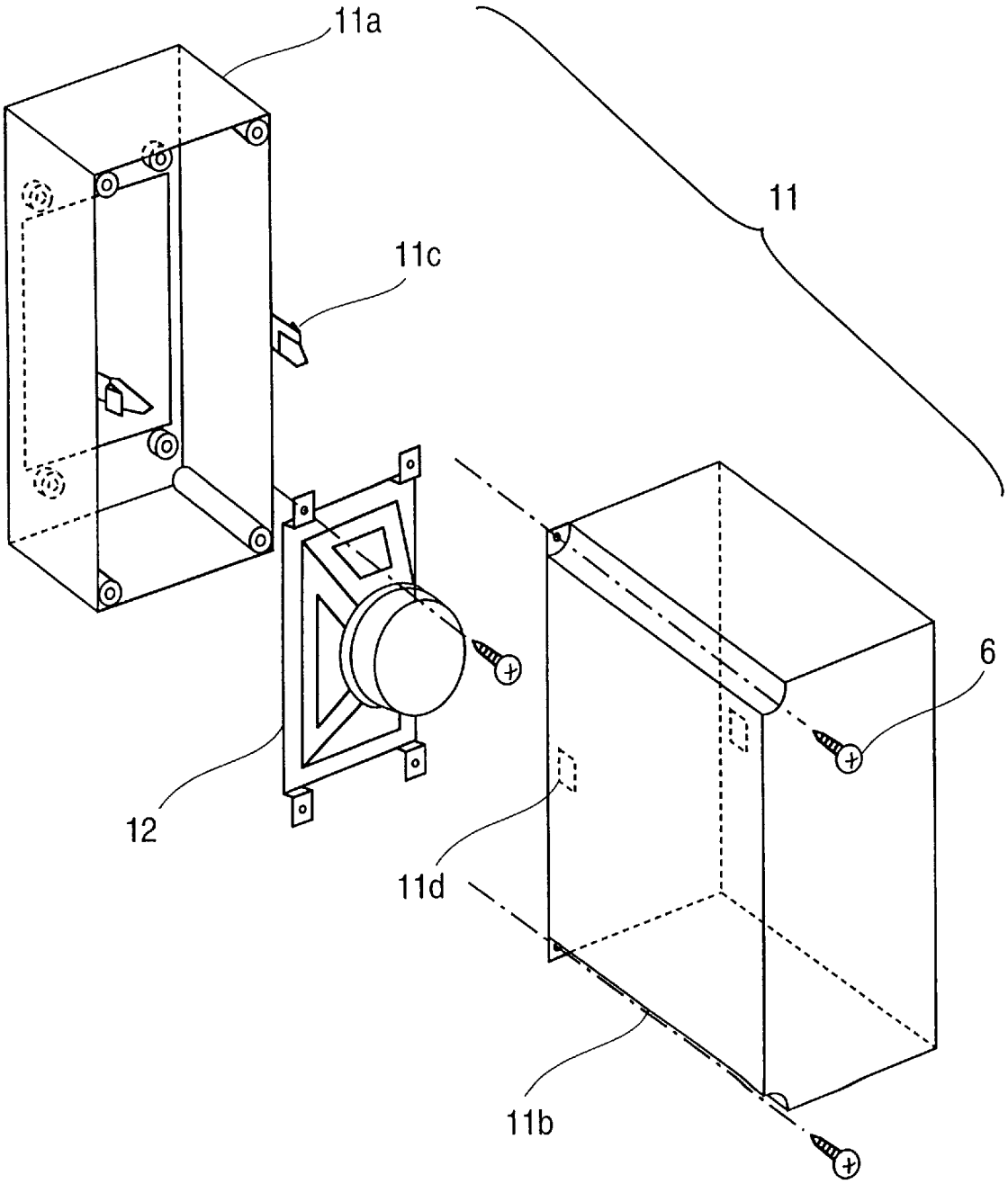
Figure 7:
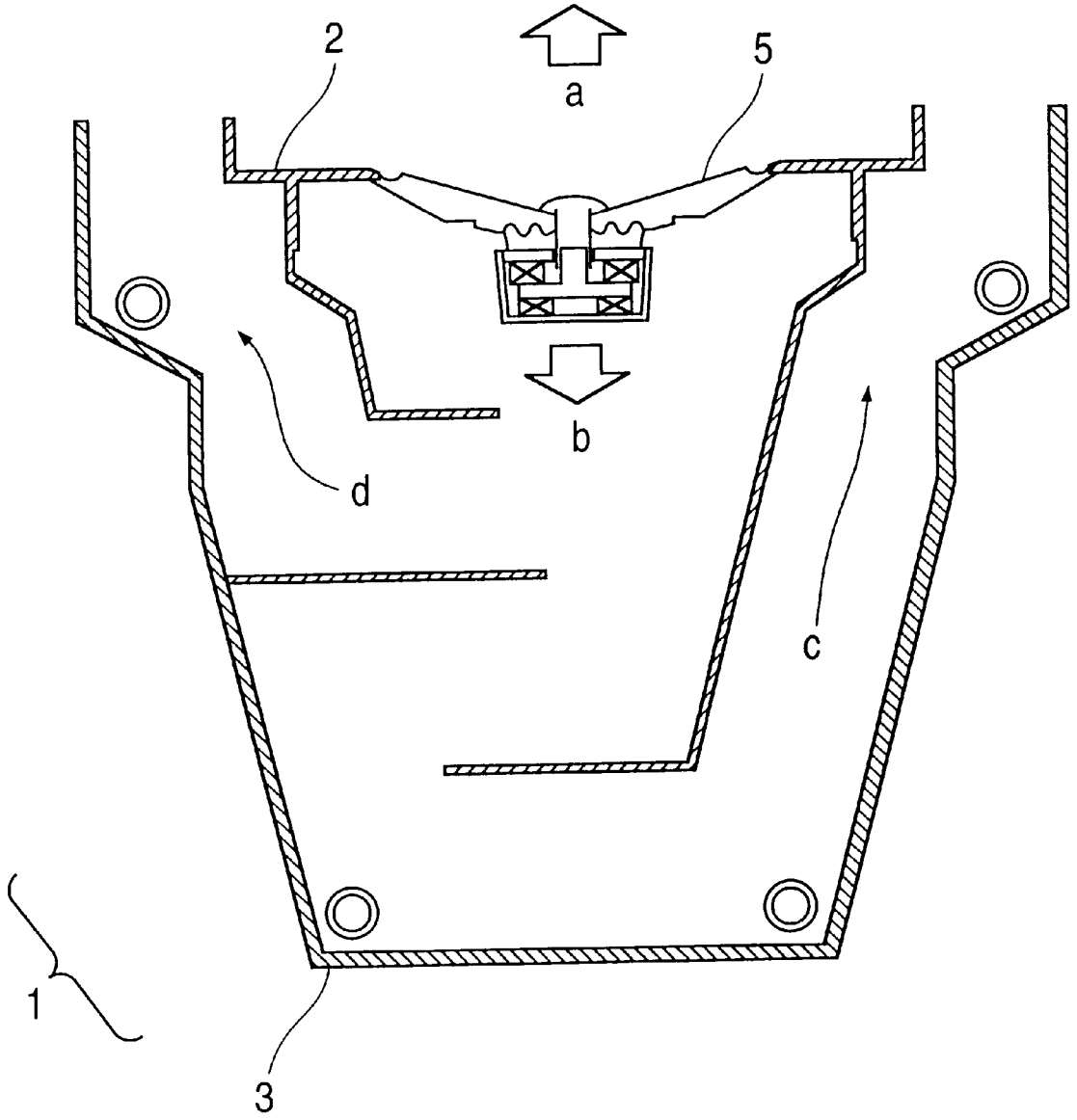
FIG. 7 (PRIOR ART)
FIG. 7 is a sectional view of a speaker system in a prior art.
Figure 8:
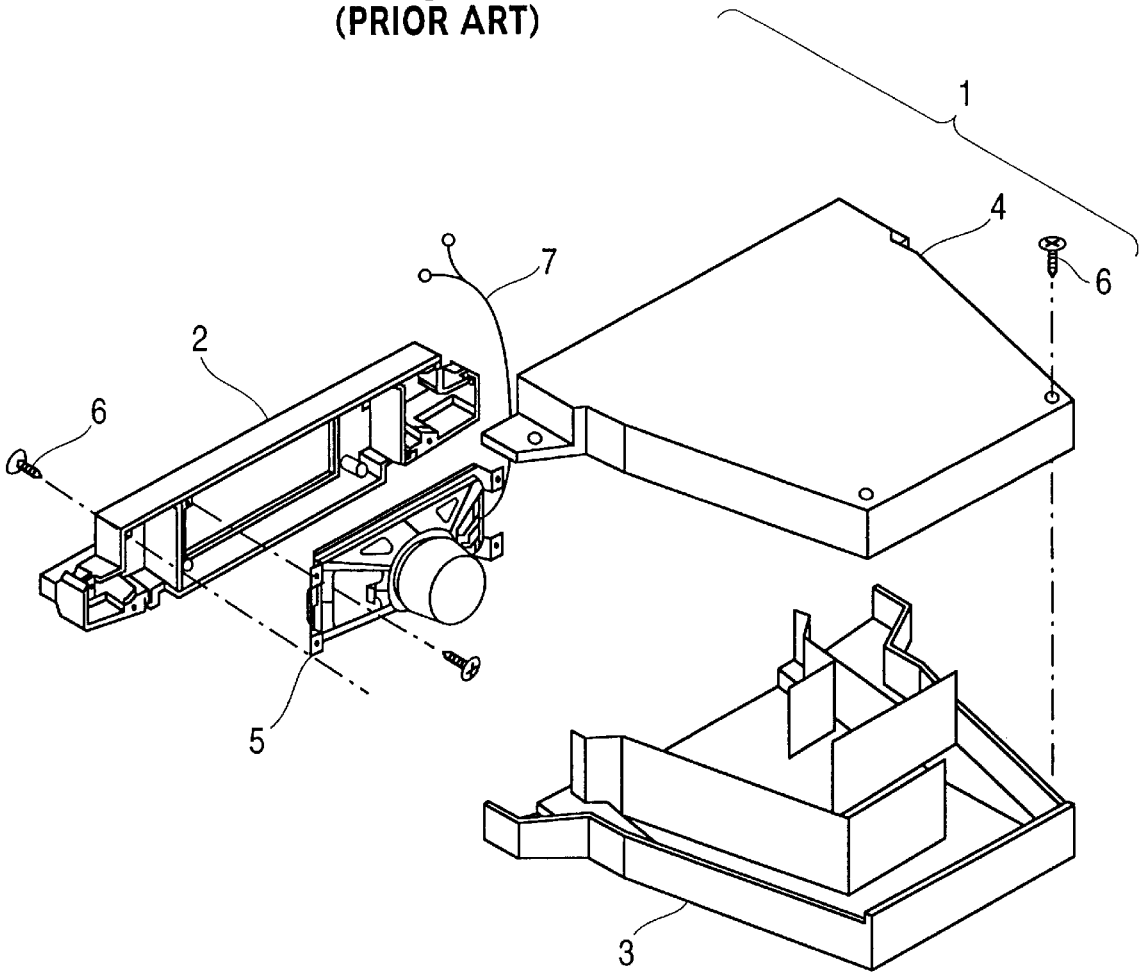
FIG. 8 (PRIOR ART)
FIG. 8 is a perspective exploded view of this speaker system.

FIG. 5 is a side sectional view of a speaker system in embodiment 3 of the invention, and FIG. 6 is its perspective exploded view. A speaker box 11 is composed of a front cabinet 11*a* for accommodating a speaker unit 12 at the front side, and a cover 11*b* as a back cabinet to be coupled with this front cabinet 11*a*.

Reference numeral 11*c* is a pawl projecting toward the cover 11*b* near the speaker unit 12 accommodating portion of the front cabinet 11*a*, and the cover 11*b* has a recess or hole 11*d* to be engaged with this pawl 11*c*, so that the pawl 11*c* and recess or hole 11*d* compose coupling means for the front cabinet 11*a* and cover 11*b* provided nearly in the middle of the longer side of the speaker box 11. Moreover, the pawl 11*c* forms a pair of coupling means at both confronting longer sides so as to grip the speaker unit 12 when it is engaged with the recess or hole 11*d*.

Thus, by the coupling means, the front cabinet 11*a* and cover 11*b* are firmly fixed, and the unwanted vibration due to rear release wave g is suppressed, and the unwanted vibration of the speaker unit 12 can be also suppressed, and further the sound pressure frequency characteristic can be enhanced. Still more, the strength as the speaker box 11 is reinforced without increasing the number of parts.

Incidentally, if the output of the speaker unit 12 is not so large and the effect of vibration of the speaker unit 12 on the speaker system is small, the coupling means may be used only to engaged the front cabinet 11*a* and cover 11*b*, and may not grip the speaker unit 12.

According to the invention, therefore, by reinforcing the coupling of the back cabinet and cover, and preventing vibration of the back cabinet and cover due to pressure of the rear release wave emitted from the speaker unit, a favorable bass range characteristic is obtained even in application of high input, and drop-out of the speaker unit is prevented even when a strong impact is given, so that an excellent speaker system can be presented.

What is claimed is:

1. A speaker system comprising:

a front cabinet having an opening, a speaker unit installed in said opening, a back cabinet and a cover for forming a space for accommodating said speaker unit together with said front cabinet, and suppressing means comprising a reinforcing post provided to stand on said back cabinet for suppressing generation of unwanted vibration, wherein said reinforcing post abuts against a surface of the rear most portion of said speaker unit and one end of said reinforcing post opposite to said back cabinet is directly connected to said cover.

2. The speaker system of claim 1, further comprising:

a sound guide contained in said space for leading out a rear release wave of said speaker unit to outside, and wherein said suppressing means comprises a flow-adjusting wall provided in said back cabinet and abutting against the surface of the rear most portion of said speaker unit for guiding said rear release wave into said sound guide.

3. The speaker system of claim 1, wherein said post has a portion for receiving a fastening member which fastens said post to a side of said back cabinet.

4. The speaker system of claim 3, wherein said post has a substantially flat portion that extends along the length of said post, and said substantially flat portion abuts against the surface of the rear most portion of said speaker unit.

5. The speaker system of claim 1, wherein said reinforcing post extends in a direction substantially parallel to the surface of the rear most portion of said speaker unit.

6. A speaker system comprising:

a front cabinet having an opening, a speaker unit installed in said opening, a back cabinet for forming a space for accommodating said speaker unit together with said front cabinet, and a suppressing means for suppressing generation of unwanted vibration, wherein said suppressing means comprises a first coupling means provided with said front cabinet, said first coupling means comprising a pawl, and a second coupling means provided with said back cabinet to be fitted with said first coupling means by engaging with said pawl, and wherein said speaker unit is gripped with one of said first coupling means and said second coupling means.

7. The speaker system of claim 6, wherein said first coupling means comprises a member for gripping said speaker unit.

8. The speaker system of claim 6, wherein said first and second coupling means are provided near said speaker unit.

9. The speaker system of claim 6, wherein said first coupling means extends towards said back cabinet and said second coupling means contains a notch which is engagable with said pawl.

10. A speaker system comprising:

a front cabinet having an opening, a speaker unit installed in said opening, a back cabinet and a cover for forming a space for accommodating said speaker unit together with said front cabinet, a sound guide contained in said space for leading out a rear release wave of said speaker unit to outside, and a flow-adjusting wall provided in said back cabinet abutting against a rear most portion of said speaker unit and fixed to said cover at one end of said flow-adjusting wall for guiding said rear release wave into said sound guide, thereby suppressing generation of unwanted vibration.

11. The speaker system of claim 10, wherein said flow-adjusting wall is connected to two opposite sides of said back cabinet and thereby further suppressing generation of unwanted vibration.

12. A speaker system of claim 10, wherein said sound guide comprises two channels for leading out said rear release wave, and said flow-adjusting wall comprises two segments for guiding said rear release wave into said two channels.

13. The speaker system of claim 10, wherein said flow-adjusting wall includes a first flow-adjusting wall of a first length, and a second flow-adjusting wall of a second length, said second length being different from said first length.

14. The speaker system of claim 10, wherein said flow-adjusting wall further includes a post connected to two sides of said back cabinet and connected to said flow-adjusting wall.

15. The speaker system of claim 10, wherein said flow-adjusting wall is coupled with a side of said back cabinet and extends in a direction substantially parallel to the surface of the rear most portion of said speaker unit.

* * * * *